US009409435B2

(12) United States Patent
Kinsman

(10) Patent No.: US 9,409,435 B2
(45) Date of Patent: Aug. 9, 2016

(54) WRITING BOARDS

(71) Applicant: SG World Limited, Cheshire (GB)

(72) Inventor: Douglas Kinsman, Cheshire (GB)

(73) Assignee: SG WORLD LIMITED, Cheshire (GB)

( * ) Notice: Subject to any disclaimer, the term of this patent is extended or adjusted under 35 U.S.C. 154(b) by 0 days.

(21) Appl. No.: 14/227,401

(22) Filed: Mar. 27, 2014

(65) Prior Publication Data

US 2014/0290012 A1 Oct. 2, 2014

(51) Int. Cl.

| | |
|---|---|
| ***B42F 13/14*** | (2006.01) |
| ***B42F 9/00*** | (2006.01) |
| ***B43L 3/00*** | (2006.01) |
| ***B43L 5/02*** | (2006.01) |

(52) U.S. Cl.

CPC ..... *B42F 13/14* (2013.01); *B42F 9/001* (2013.01); *B42F 9/008* (2013.01); *B43L 3/00* (2013.01); *B43L 5/02* (2013.01); *Y10T 24/203* (2015.01)

(58) Field of Classification Search

CPC ..... B42F 13/14; B42F 9/001; B42F 9/008
USPC ..... 402/60, 61, 68
See application file for complete search history.

(56) References Cited

U.S. PATENT DOCUMENTS

| | | | | | |
|---|---|---|---|---|---|
| 687,941 | A * | 12/1901 | Radford | 402/22 |
| 971,007 | A * | 9/1910 | Hubbard | 402/61 |
| 1,900,601 | A * | 3/1933 | Felder | 402/61 |
| 1,980,630 | A * | 11/1934 | Otto | 402/61 |
| 1,999,553 | A * | 4/1935 | Widder | 402/61 |
| 3,087,498 | A * | 4/1963 | Vogel | B42F 13/12 281/15.1 |
| 3,260,264 | A * | 7/1966 | McKowen | 402/22 |
| 4,165,193 | A * | 8/1979 | Gestetner | 402/61 |
| 2007/0098486 | A1 | 5/2007 | Ho | |
| 2008/0092343 | A1 | 4/2008 | Unda et al. | |
| 2009/0019672 | A1* | 1/2009 | Moore | B42F 9/001 24/67.3 |
| 2010/0209176 | A1* | 8/2010 | Okamura | 402/60 |

FOREIGN PATENT DOCUMENTS

| | | |
|---|---|---|
| CN | 201309325 | 9/2009 |
| DE | 3329458 A1 | 3/1985 |
| DE | 202005009646 | 9/2005 |
| EP | 0628432 A1 | 12/1994 |

(Continued)

OTHER PUBLICATIONS

Examination Opinion and Search Report issued in priority Application No. GB1035662.7, dated Feb. 14, 2014.

*Primary Examiner* — Kyle Grabowski
(74) *Attorney, Agent, or Firm* — Pearne & Gordon LLP

(57) ABSTRACT

A writing board for retaining material for writing, the writing board having a main board defining a surface and a material retaining arrangement configured to retain material on the surface, the retaining arrangement further having a retaining portion movable between a first retaining position at which material can be retained thereby on the board and a second position that allows material to be removed from the board, the retaining portion bearing a first part of a snap fastener, which first part is releasably engageable with a second part of the snap fastener located on the board, one of the first and second parts having a projection that locates into a re-entrant portion in the other of the first and second parts to extend through a hole in material being retained thereby when the retaining portion is in the first retaining position.

18 Claims, 4 Drawing Sheets

(56) References Cited

FOREIGN PATENT DOCUMENTS

| | | | |
|---|---|---|---|
| FR | 152807 A | 1/1922 | |
| GB | 152807 | 10/1920 | |
| JP | 2005335359 | 12/2005 | |
| JP | 2008207468 | 9/2008 | |

* cited by examiner

WRITING BOARDS

The present invention relates to writing boards.

The term "writing board(s)" is used in the present specification to refer to articles, generally in the form of a board or folder, on or in which writing or written materials such as paper, card, plastics or other functionally equivalent materials can be securely retained, whether to be written on when retained or otherwise.

Writing boards have many uses, and for certain such uses the ability for a board to be able to securely retain a plurality of sheets or plies of material in fixed relative position is important.

One such use is as a visitor management system, often used by businesses and other establishments to register and monitor the arrival and subsequent departure of personnel, visitors and the like.

For these sorts of registers, it is often necessary to retain a series of sheets of material, usually paper, card and the like, on which registration entries can be made (often by hand). Such sheets of material, often paper or thin card, are selectively torn out for use after the requisite entries have been made on them, as or as part of a badge or similar such identifier to be worn by the visitor, etc.

Maintaining such series of pieces of material in correct alignment is often necessary, particularly where the data written thereon is replicated through copying means, such as carbon paper, carbonless paper and the like, appropriately located relative to the material. The board typically provides a surface against which those materials can be held whilst the written information is entered.

According to aspects of the present invention there is provided a writing board for retaining material for writing on, the writing board comprising a main board defining a surface and a material retaining arrangement configured to retain material on the surface, the retaining arrangement comprising a retaining portion moveable between a first retaining position at which material can be retained thereby on the writing board and a second position that allows material to be removed from the board, the retaining portion bearing a first part of a two part snap fastener which first part is releasably engagable with a second part of the snap fastener located on the board, one of the first and second parts having a projection that locates in a re-entrant portion in the other of the first and second parts to extend through a hole in material being retained thereby when the retaining portion is in the first retaining position.

The retaining portion may be attached to extend from the main board and may be movable through a hinged or other rotational movement between the said first and second positions.

The retaining portion may be moveable about one or more resilient hinge portions preferably located between the retaining portion and the main board and that enable(s) a pivotal movement of the retaining portion on the board.

The retaining portion may extend along an edge of the main board. Alternatively, a plurality or series of retaining portions may extend along one or more edges of the main board.

A series of snap fasteners may be provided along and maybe along the length of the retaining portion and/or the series of retaining portions and one or more an edges of the board.

Clamping material may be provided to locate between the main board and a retaining portion when in the first retaining position. The clamping material may be compressible and preferably resiliently compressible. The clamping material may comprise a foamed, rubberised or other elastomeric material and may be attached to one or more of the retaining portion(s) and/or the main board.

The snap fastener projection may have a recess formed partway along its length in which releasably engages a resiliently biased locator mounted in a re-entrant portion when the projection is located therein.

The recess may extend around the projection to define a groove.

The locator may comprise a sprung member which extends across the re-entrant portion maybe at or near one side of the re-entrant portion to snap into the recess to engage the first and second parts.

The projection may locate in the re-entrant portion by a snap fit action and may similarly dislocate by a reverse snap fit action.

According to further aspects of the present invention there is provided writing apparatus comprising a writing board as defined in any of the preceding ten paragraphs and material for location on the board.

Embodiments of the present invention will now be described by way of example only, with reference to the accompanying drawings, in which.

Figure 1:
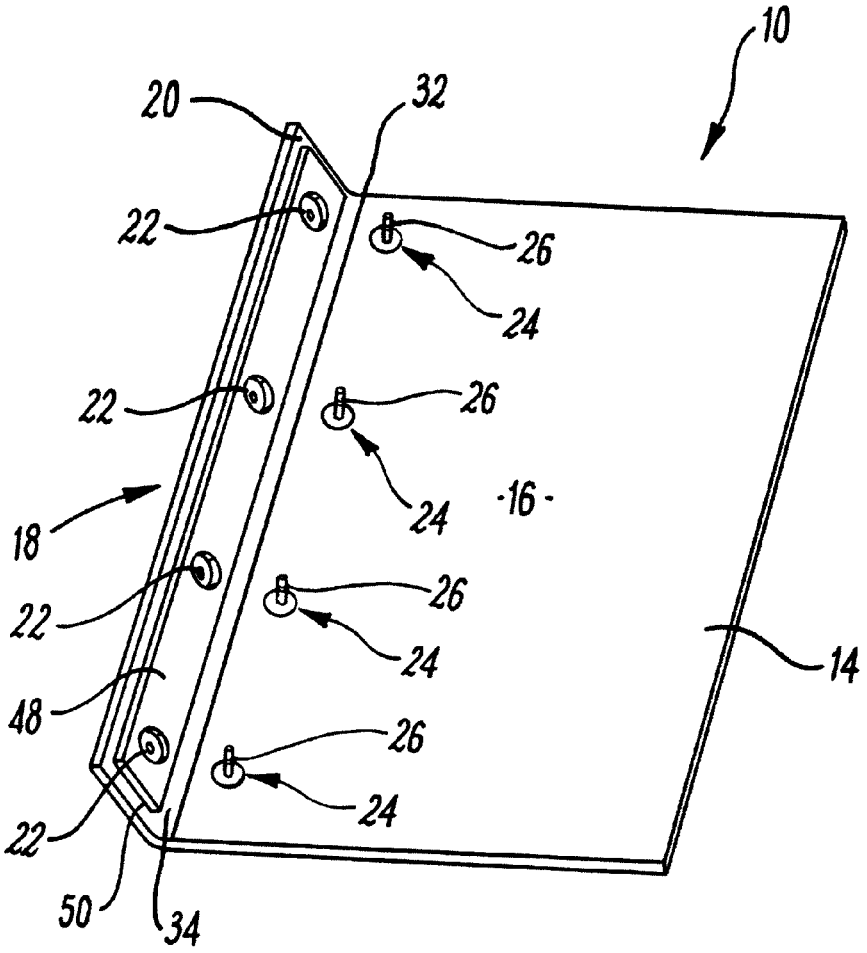
FIG. 1 is a perspective view of a writing board according to the present invention in an open condition.

With reference to the drawings, there is provided a writing board 10 for retaining material 12 for writing, the writing board 10 comprising a main board 14 defining a surface 16 and a material retaining arrangement 18 configured to retain material 12 on the surface 16, the retaining arrangement comprising a retaining portion 20 moveable between a first retaining position at which material 12 can be retained thereby on the board 10 and a second position that allows material 12 to be removed from the board 10, the retaining portion 20 bearing a first part 22 of a snap fastener, which first part 22 is releasably engagable with a second part 24 of the snap fastener located on the board, one of the first and second parts 22, 24 having a projection 26 that locates into a re-entrant portion 28 in the other of the first and second parts 22, 24 to extend through a hole 30 in material 12 being retained thereby when the retaining portion 20 is in the first retaining position.

In more detail, the writing boards 10 of the present invention have many uses, being able to securely yet releasably retain multiple plies of material for writing on, such as paper and the like, in relative fixed position. One particular application is as a registration management system, particularly a visitor management system as discussed above. Such systems typically not only enable recordal of the registration of the presence and departure of a visitor, such as to particular premises, but enable generation of a badge or similar such identifier typically by removal of a part of the material retained thereon from the writing board to be worn by the visitor.

The registering and monitoring of visitors often helps compliance with prevailing legislation and regulations, as well as enabling the general monitoring of the presence and movement of visitors, personnel, etc.

It is often important that a series of sheets of paper or similar such material can be retained in the correct position relative to each other and often relative to copying or replicating material such as carbonless paper, carbon paper or similar so as to allow each entry to be replicated on a central docket or register. This has typically resulted in elaborate and relatively expensive retention mechanisms being developed to retain the materials in this way.

The writing board of the present invention presents a novel writing board that finds particular application in relation to visitor management systems, as well as application as a writing board generally.

With particular reference to FIG. 1, a writing board 10 of the present invention is shown in an open condition and comprises a main board 14 which is of generally planar, rectangular configuration and sized to provide a useful surface 16 against which materials such as paper, card, cardboard, plastics or other suitable, generally paper-like materials can be held and which provides a support or surface for these materials to facilitate a person writing or otherwise making inscriptions.

The main board 14 comprises a board or panel of any suitable, preferably rigid or semi-rigid material such as plastics, cardboard or similarly functionally equivalent material which in turn may be covered by a suitable covering such as plastic, leather, leatherette coating or the like.

The retaining portion 20 extends along one edge 32 of the main board 14 about a resilient hinge portion 34 that in use provides for a hinged movement of the retaining portion 20 about the edge 32 of the main board 14.

The resilient portion 34 may conveniently be made of a resilient material, and may be comprised of the covering used to cover both the main board 14 and the retaining portion 20.

The retaining portion 20 comprises a strip or panel of a rigid or semi-rigid material, which may be the same as that of the board or panel of the main board 14.

The strip/panel of the retaining portion 20 and the board/panel of the main board 14 may be held in spaced alignment by the covering which extends over them both, the covering providing the resilient portion where it extends over the space therebetween.

A series of snap fasteners is provided generally along the edge 32. FIG. 1 illustrates a series of four snap fasteners. As illustrated, the series of first parts 22 extends along the length of the retaining portion 20 in generally equispaced arrangement. The corresponding second parts 24 are secured to the main board 14 in similar arrangement to be alignable with the respective first parts 22 in use.

Suitable snap fasteners include press studs, snaps and poppers.

The second parts 24 are secured to the main board by conventional means. This may be by way of mechanical fastening, adhesive or the like.

Similarly, the first parts 22 are likewise secured to the retaining portion 20 by conventional means.

Figure 2:
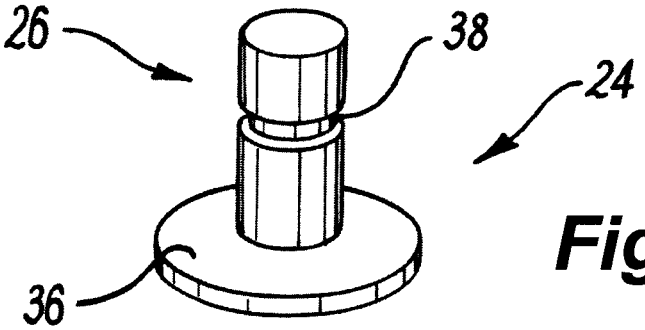
FIG. 2 is a perspective view of one part of a snap fastener.

FIG. 2 is an enlarged diagrammatic illustration of a second part 24 of a snap fastener. The second part 24 comprises a generally circular, planar base 36 from which the said projection 26 extends. The projection 26 is illustrated as being generally cylindrical in shape, having a recess 38 formed around its circumference partway along its length, to produce an annular groove.

Figure 3:
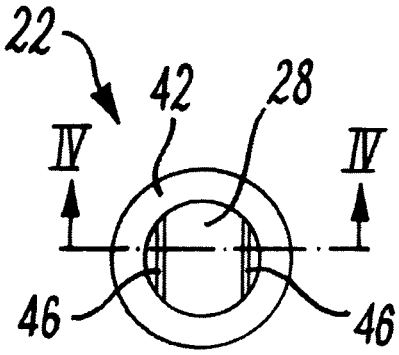
FIG. 3 is a plan view of a second part of a snap fastener.
Figure 4:
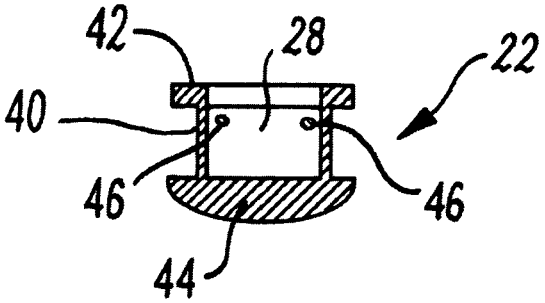
FIG. 4 is a cross-sectional view of the second part of the snap fastener of FIG. 3 along the line IV to IV.

FIGS. 3 and 4 are enlarged illustrations of a first part 22 of a snap fastener. The first part 22 comprises a generally cylindrically shaped body 40 which defines the re-entrant portion 28. An annular lip 42 extends around the opening of the re-entrant portion 28 and an enlarged head portion 44 closes off the re-entrant portion 28 at the opposite end of the part 22. A resiliently biased locator 46 in the form of two sprung members extends across the re-entrant opening 28 in generally parallel configuration to be locatable in use in a groove 38.

With reference to FIG. 1, clamping material 48 in the form of a strip of a resilient foamed material 48 is provided along the retaining portion 20 on a surface 50 of the retaining portion that in use faces the main board 14. In the strip of material 48 illustrated, appropriately sized holes are provided to expose the re-entrant formation 28 of each first part 22 and through which the second parts 26 of the snap fasteners can extend to engage with the respective first parts 22.

The clamping material 48 may be retained on the first portion by any suitable means, but typically adhesive would be used. The clamping material may be of any suitable preferably resiliently compressible material, such as foamed, rubberised or other elastomeric material.

The writing board 10 is used to retain writing material, such as paper, and is particularly useful for retaining a plurality of sheets thereof in a secure yet releasable manner that retains the various sheets in relative position and alignment.

Figure 5:
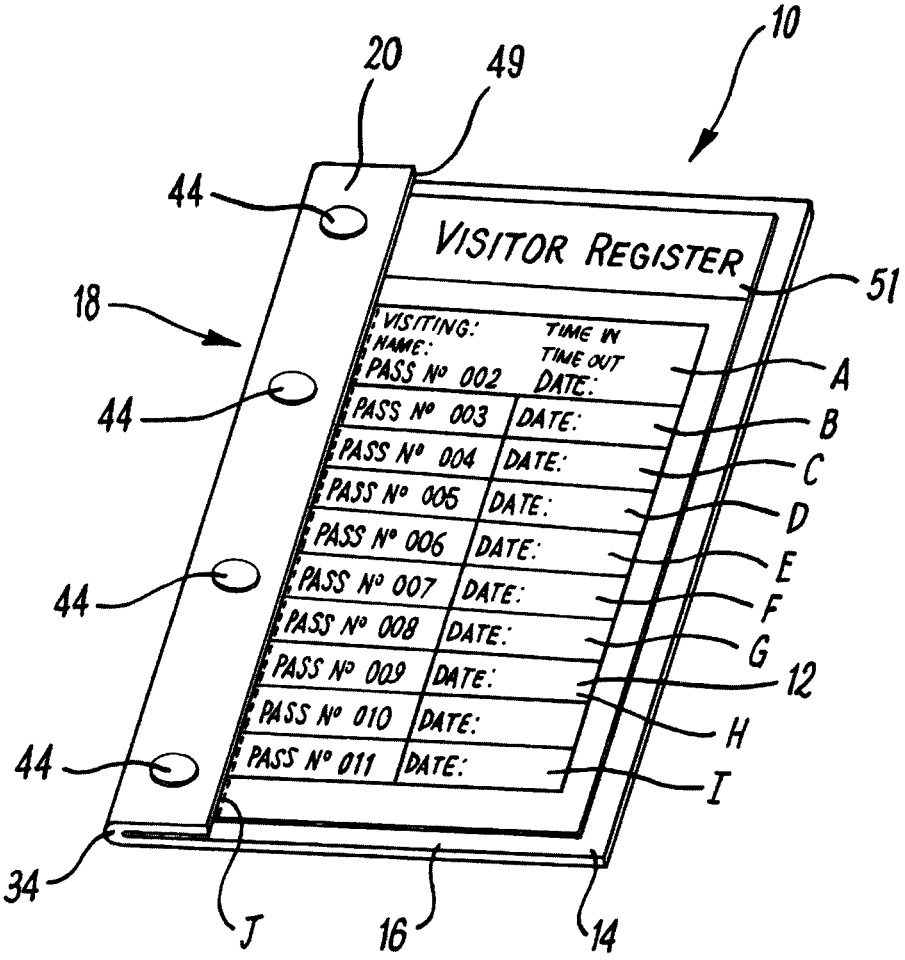
FIG. 5 is a perspective view of the writing board of FIG. 1, retaining material thereon and in a closed condition.

One such use is as a writing board for a visitor register or management system, which is diagrammatically illustrated in FIG. 5.

FIG. 5 illustrates a writing board 10 in closed condition retaining multiple sheets of paper, A to I, in partial overlapping relation, in a manner that enables them to be sequentially and selectively removed from the board 10. Typically, behind such series of sheets is held a replicating medium, such as carbonless or carbon paper, which copies data written onto each of the sheets A to I onto a record sheet 51 that sits on the board 10, behind the series of sheets A to I.

Typically, when a visitor arrives to be registered the next available sheet in a series (Pass No 002 as illustrated) is completed by the visitor or an attendant writing the requisite data onto the sheet A. In so doing, that data is copied by the copying medium onto a central record. The sheet A is then detached, typically by tearing it, usually across a weakened or perforated line or region J which runs just alongside the outer edge 49 of the retaining portion 20, which sheet is then used (typically worn) by the visitor as a means of identification.

Figure 6:
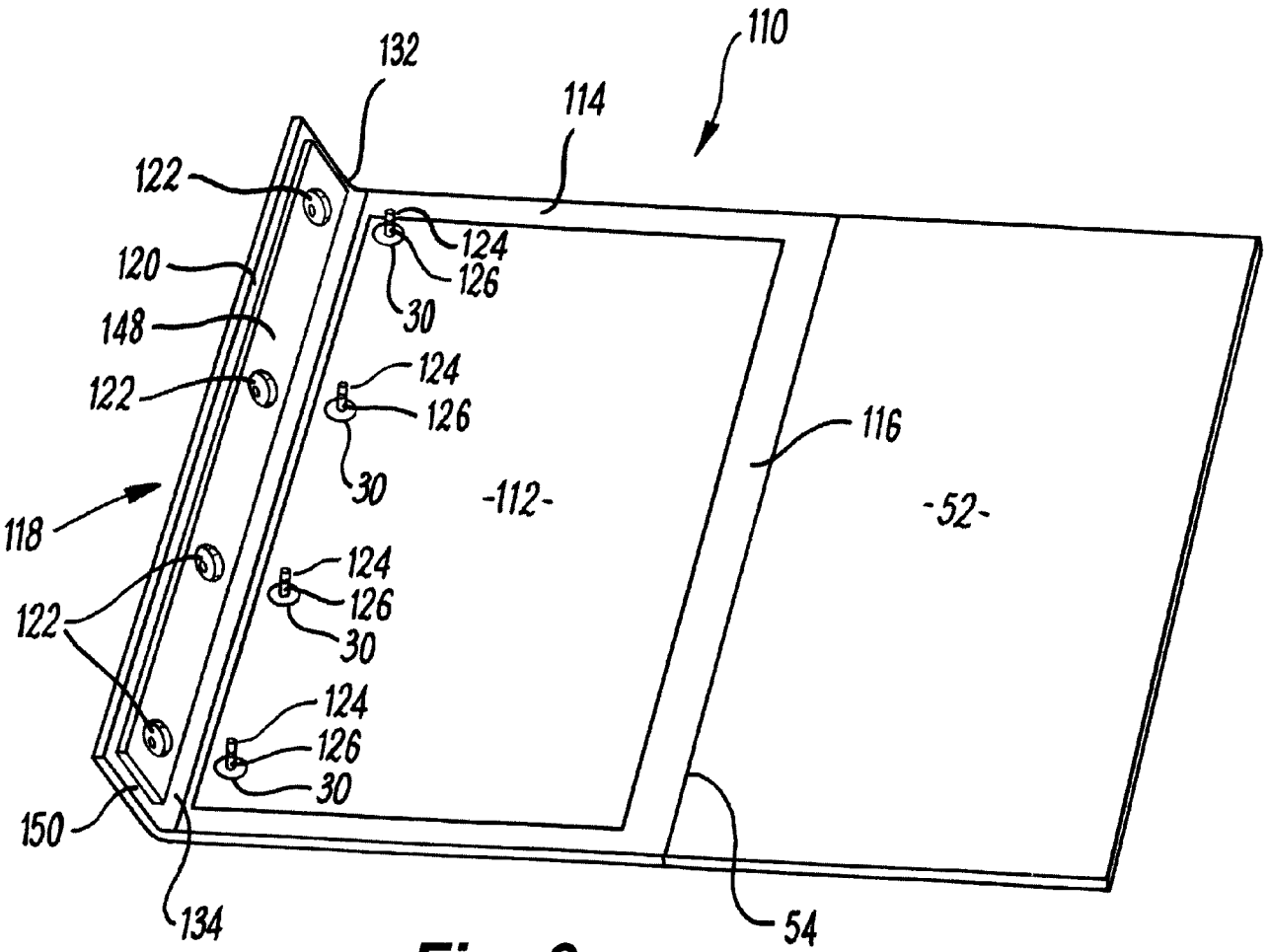
FIG. 6 is a perspective view of a writing board according to a second embodiment of the present invention.

To prepare the board 10 for use, the writing materials, such as the series of paper sheets illustrated in FIG. 5, are located over the upstanding projections 26 so that the materials lie over the surface 16 of the board 14 (as can be seen in FIG. 6). The retaining portion 20 is then moved through a generally pivotal motion about the resilient portion 32 to align the projections 26 with the re-entrant portions 28 and the respective first parts 22.

Pressure is then applied to urge the projections 26 into the respective re-entrant portions 28, against the resilience of the locators 46, such that the projections 26 urge the locators 46 apart to allow the projections 26 into the re-entrant portion until the locators 46 locate into the groove 38 on each projection to secure the first part 22 to the second part 24 by way of a snap fit, thereby securing the retaining portion 24 in position over the edge region of the main board 14 and clamp the writing materials therebetween, as can be seen in FIG. 5.

It has been found that providing the resilient strip of clamping material 48 between the retaining portion 20 and the main board 14 helps to securely clamp and retain papers between the retaining portion 20 and the main board 14. The resilience, compressibility and dimensions of the material 48 can be chosen to provide the required degree of retentive force in conjunction with the snap fasteners to provide the required degree of clamping. The provision of the clamping material 48 facilitates the selective detachment of sheets A to I by providing the appropriate degree of clamping or retention pressure on the sheets, generally along a line of detachment. By holding the sheets securely and closely along the line J, the arrangement 18 has been found to enable relatively easy removal of one or more sheets, without damage to those or the remaining sheets or other parts of the material. Providing clamping material according to aspects of the present invention enables a relatively small number of snap fasteners to be used, thus simplifying and thus reducing the cost of production.

FIG. 6 illustrates a writing board 110 according to a further embodiment of the present invention. The board 110 is generally similar to the board 10, and corresponding features are referenced with corresponding reference numerals, prefaced with "1". The writing board 110 however also comprises an overlay panel 52 as shown, which when the writing board 110 is not in use, can be folded over the main board 14 about a fold line 54 such as to protect the materials held by the board 110 when the board 110 is not in use.

Various modifications may be made without departing from the scope of the present invention.

The number and arrangement of the snap fasteners can be selected according to the desired utility of the writing board. More or less than the four illustrated can be provided as an aligned series, or indeed more than one series could be used.

The retaining portion may extend along the top and/or bottom edge rather than or as well as along a side edge as illustrated.

It will be appreciated that clamping material may be located on the main board 14, such as in the form of a strip similar to that illustrated. It will be further appreciated that clamping material can be provided on both the retaining portion 20 and the main board if desired. The clamping material may be formed of a number of discrete sections or pieces that for example would be located between the first and/or second parts of the snap fasteners, rather than having holes formed in the material as illustrated.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A writing board for retaining material for writing on, the writing board comprising a main board defining a surface and a material retaining arrangement configured to retain material on the surface, the retaining arrangement comprising a retaining portion moveable between a first retaining position at which the material can be retained thereby on the writing board and a second retaining position that allows the material to be removed from the writing board, and resiliently compressible clamping material located between the main board and the retaining portion when the retaining portion is in the first retaining position, the clamping material comprises a foam, rubberized or elastomeric material and is attached to one of the retaining portion and the main board, the retaining portion bearing a first part of a two part snap fastener which the first part is releasably engagable with a second part of the two part snap fastener located on the writing board, one of the first and the second parts having a projection that locates in a re-entrant portion in the other of the first and the second parts to extend through a hole in the material being retained thereby when the retaining portion is in the first retaining position, the clamping material is compressed against material being retained when such material is present, said compression being caused and maintained by movement of the retaining portion into the first retaining position, and the compression of the clamping material causes the clamping material to exert a clamping pressure on material being retained.

2. The writing board of claim 1, wherein the retaining portion is attached to extend from the main board.

3. The writing board of claim 1, wherein the retaining portion is moveable through a hinged or other rotational movement between the first and second retaining positions.

4. The writing board of claim 1, wherein the retaining portion is moveable about one or more resilient hinged portions that enable a pivotal movement of the retaining portion on the writing board.

5. The writing board of claim 4, wherein the one or more resilient hinged portions are located between the retaining portion and the main board.

6. The writing board of claim 1, wherein the retaining portion extends along an edge of the main board.

7. The writing board of claim 1, wherein a plurality or series of retaining portions extends along one or more edges of the main board.

8. The writing board of claim 7, wherein a series of snap fasteners is provided along the series of retaining portions.

9. The writing board of claim 1, wherein a series of snap fasteners is provided along the retaining portion.

10. The writing board of claim 9, wherein the series of snap fasteners is provided along the length of the retaining portion.

11. The writing board of claim 1, wherein a series of snap fasteners is provided along one or more edges of the main board.

12. The writing board of claim 1, wherein the projection has a recess formed partway along its length for releasably engaging a resiliently biased locator mounted in the re-entrant portion when the projection is located therein.

13. The writing board of claim 12, wherein the recess extends around the projection to define a groove.

14. The writing board of claim 12, wherein the locator comprises a sprung member which extends across the re-entrant portion to snap into the recess to engage the first and second parts of the two part snap fastener.

15. The writing board of claim 14, wherein the sprung member extends across the re-entrant portion at or near one side of the re-entrant portion.

16. The writing board of claim 1, wherein the projection locates in the re-entrant portion by a snap fit action.

17. The writing board of claim 1, wherein the projection dislocates from within the re-entrant portion by a snap fit action.

18. The writing board of claim 1, wherein the clamping material comprises a hole to accommodate the projection.

* * * * *